US008012069B2

(12) United States Patent
Towley, III et al.

(10) Patent No.: US 8,012,069 B2
(45) Date of Patent: Sep. 6, 2011

(54) SELECTORIZED DUMBBELL HAVING OR CONVERTIBLE INTO KETTLEBELL CONFIGURATION

(75) Inventors: Carl K. Towley, III, Alexandria, MN (US); Gregory S. Olson, Owatonna, MN (US)

(73) Assignee: Power Block Holdings, Inc., Owatonna, MN (US)

( * ) Notice: Subject to any disclaimer, the term of this patent is extended or adjusted under 35 U.S.C. 154(b) by 0 days.

(21) Appl. No.: 12/847,310

(22) Filed: Jul. 30, 2010

(65) Prior Publication Data

US 2011/0028285 A1 Feb. 3, 2011

Related U.S. Application Data

(60) Provisional application No. 61/229,857, filed on Jul. 30, 2009.

(51) Int. Cl.
*A63B 210/072* (2006.01)

(52) U.S. Cl. ..... 482/108; 482/107

(58) Field of Classification Search ..... 482/93, 482/106–108, 908, 910
See application file for complete search history.

(56) References Cited

U.S. PATENT DOCUMENTS

| | | | | |
|---|---|---|---|---|
| 1,917,566 | A | 7/1933 | Wood | |
| 4,627,618 | A | 12/1986 | Schwartz | |
| 4,743,017 | A | 5/1988 | Jaeger | |
| 4,768,780 | A | 9/1988 | Hayes | |
| D359,778 | S | 6/1995 | Towley, III et al. | |
| 5,637,064 | A | 6/1997 | Olson et al. | |
| 7,052,445 | B2 | 5/2006 | Ekhaus | |
| 7,491,155 | B2 * | 2/2009 | Fenelon et al. | 482/107 |
| 7,811,212 | B2 * | 10/2010 | Chen | 482/107 |
| 2008/0254953 | A1 * | 10/2008 | Krull | 482/107 |

OTHER PUBLICATIONS

Atomic Athletic photograph of York Kettlebell Handle, dated 2006, showing a red U-shaped kettlebell style handle having legs that are slid onto the usual handle of a standard dumbbell.

Oldtime Strongman Blog, dated Feb. 18, 2008, showing a U-shaped kettlebell style handle that can be retrofitted onto the usual handle of a standard dumbbell.

Oldtime Strongman Blog, dated Oct. 1, 2007, showing a T-shaped kettlebell style handle that can have a plurality of weight plates attached to the lower end of the stem of the T with the top of the T forming a loop that can be gripped by the user.

* cited by examiner

*Primary Examiner* — Glenn Richman
(74) *Attorney, Agent, or Firm* — James W. Miller

(57) ABSTRACT

A selectorized dumbbell has nested stacks of left and right weight plates, a handle that can be disposed between the two stacks of weight plates, and a selector that couples selected numbers of the left and right weight plates to left and right planar ends of the handle. The handle has at least one loop type hand grip located above the ends of the handle and above the weight plates to allow the dumbbell to be used as a kettlebell. This loop type hand grip can be replaced with a bar type hand grip if the dumbbell is to be used like a standard dumbbell, or the handle can be provided in kettlebell or standard versions thereof. Alternatively, the loop type hand grip can be movably disposed on the handle for movement between operative and non-operative positions.

14 Claims, 4 Drawing Sheets

SELECTORIZED DUMBBELL HAVING OR CONVERTIBLE INTO KETTLEBELL CONFIGURATION

CROSS REFERENCE TO RELATED APPLICATIONS

This application claims the benefit of one or more previously filed provisional applications identified as follows: Application Ser. No. 61/229,857 filed Jul. 30, 2009.

TECHNICAL FIELD

This invention relates to the field of exercise equipment and specifically to hand held weights in the form of dumbbells.

BACKGROUND OF THE INVENTION

Adjustable weight dumbbells are known that use an elongated, cylindrical bar as the handle. An inner collar is inset inwardly from each end of the bar with the collar being releasably fixed to the bar by some type of fastener or holding device. The inset provides a space on each end of the bar that is used to support one or more weight plates on the ends of the bar outboard of the inner collars. After the user stacks a desired number of weight plates on the ends of the bar, the user installs an outer collar on each end of the bar to hold the stacked weight plates on the ends of the bar to prevent the weight plates from sliding off the bar during exercise. The user adjusts the exercise mass of the dumbbell by changing the number of weight plates that are held between the inner and outer collars on each end of the bar. Typically, the weight plates are flat, circular plates having a central bore for slipping the weight plates onto the bar.

To use the dumbbell described above, the user merely grabs the center of the bar between the stacks of weight plates on the ends of the bar. Inherently, the user's hand is positioned centrally between the stacks of weight plates along a centerline of the bar, which is also a centerline of the stacked weight plates. The user can then lift and manipulate the dumbbell in any of the known ways to perform various weight training exercises, such as arm curls, arm presses, etc.

In the past, one manufacturer of dumbbells of the type described above has offered an optional U-shaped handle for converting this type of dumbbell to a kettlebell style. The bottoms of the spaced legs of the U-shaped handle were formed with circular bores that were designed to slide onto the bar that formed the usual handle for the dumbbell. The user would remove weight plates and the inner and outer collars from one end of the bar to provide access to the center of the bar. The user would then slip the U-shaped handle onto the bar from this end of the bar, namely the end of the bar from which the weight plates and collars had been removed, simply by telescoping or inserting the bores in the legs of the U-shape onto the bar and by then sliding the U-shaped handle inwardly to the center of the bar. The removed weight plates and collars could then be replaced onto the end of the bar from which they had been taken.

When so installed as described above, the U-shaped handle was captured between the inner collars on the bar. In addition, the legs of the U-shaped handle were long enough so that the base of the U-shaped handle, namely the connecting piece between the two legs of the handle, was positioned to be parallel to the bar but to be vertically displaced above the weight plates. Thus, the user could now grab the base of the U-shaped handle and swing or manipulate the dumbbell in the manner of a kettlebell. Thus, a standard adjustable weight dumbbell could be converted in this manner to a kettlebell type of exercise device.

Other adjustable weight dumbbells are known which are referred to as selectorized dumbbells, such as that shown in U.S. Pat. No. 5,637,034 as also shown in FIG. 1 of this application. In such a dumbbell, the handle is no longer a simple, cylindrical bar, but has a more complex shape. The handle of this type of dumbbell has a pair of planar ends that are spaced apart from one another but are rigidly joined to one another at least by a central hand grip that extends between the ends and is affixed thereto. In addition to the hand grip, there may be one or more cross tubes that also extend between and unite the spaced planar ends of the handle together. Some type of movable selector is used which coacts with the handle and with a desired number of weight plates disposed in left and right stacks of weight plates. When the selector is moved between different positions relative to the handle, different numbers of weight plates are coupled to the left and right ends of the handle to adjust the exercise mass of the selectorized dumbbell.

In a selectorized dumbbell of the type described above and as shown in FIG. 1 of this application, there is no way to use the U-shaped handle of prior dumbbells with the selectorized dumbbell to provide a kettlebell style of exercise. The U-shaped handle of the prior dumbbell is designed to slip onto a bar from which access can be had from one end of the bar. In the selectorized dumbbell, even if one considers the hand grip a bar, the ends of the hand grip are united to planar left and right ends of the handle thereby blocking access to the hand grip. There is simply no way to slide an auxiliary U-shaped handle onto the hand grip of the handle of the selectorized dumbbell as one is blocked from doing so by either the planar left end of the handle or the planar right end of the handle. It would be an advance in the art to provide some way of converting this type of selectorized dumbbell into a kettlebell type of exercise device.

SUMMARY OF THE INVENTION

One aspect of this invention relates to a selectorized dumbbell which comprises a plurality of nested weights comprising a stack of nested left weight plates and a stack of nested right weight plates separated by a gap. At least a first handle is provided with the handle having a hand grip extending along an axis with the handle further having opposite, substantially planar left and right ends that are rigidly joined to one another. The handle may be dropped down into the gap between the stacks of nested left and right weight plates such that the left end of the handle is adjacent an innermost left weight plate in the left stack of weight plates and the right end of the handle is adjacent an innermost right weight plate in the right stack of weight plates. A selector is movable into different positions relative to the handle and relative to the weight plates for coupling selected numbers of left weight plates to the left end of the handle and selected numbers of right weight plates to the right end of the handle. The hand grip of the first handle comprises an upwardly extending loop that is fixed at a bottom portion thereof between the left and right ends of the handle to join the left and right ends of the handle together and with the loop having a top gripping portion that is vertically positioned above the left and right ends of the handle and above top edges of the weight plates in the manner of a kettlebell exercise device.

Another aspect of this invention relates to a selectorized dumbbell, which comprises a plurality of nested weights comprising a stack of nested left weight plates and a stack of nested right weight plates separated by a gap. A handle is provided having a first hand grip extending along an axis with the handle further having opposite, substantially planar left and right ends joined to opposite ends of the hand grip with the left and right ends of the handle extending perpendicularly to the hand grip. The first hand grip of the handle extends substantially horizontally between top and bottom edges of the left and right ends of the handle such that the first hand grip of the handle will be located below top edges of the weight plates in the manner of a standard dumbbell. A selector is movable into different positions relative to the handle and relative to the weight plates for coupling selected numbers of left weight plates to the left end of the handle and selected numbers of right weight plates to the right end of the handle. A second hand grip is provided comprising a loop that is carried on the handle. The loop is movable relative to the handle between a first operative position in which a top gripping portion of the loop is vertically positioned above the left and right ends of the handle and above top edges of the weight plates in the manner of a kettlebell exercise device and a second non-operative position in which the top gripping portion of the loop is disposed between the left and right ends of the handle. The user can use the dumbbell in the manner of a kettlebell exercise device by moving the second hand grip comprising the loop into its first, operative position and by grasping the top gripping portion of the loop or in the manner of a standard dumbbell by disposing the top gripping portion of the loop in its second non-operative position and by grasping the first hand grip rather than the top gripping portion of the loop.

Yet another aspect of this invention relates to a selectorized dumbbell which comprises a plurality of nested weights comprising a stack of nested left weight plates and a stack of nested right weight plates separated by a gap. A handle is provided having opposite, substantially planar left and right ends that are rigidly joined to one another. The handle may be dropped down into the gap between the stacks of nested left and right weight plates such that the left end of the handle is adjacent an innermost left weight plate in the left stack of weight plates and the right end of the handle is adjacent an innermost right weight plate in the right stack of weight plates. The handle carries a pair or hand grips thereon comprising a first cylindrical bar type hand grip that in use is substantially horizontal and extends between the left and right ends of the handle and is disposed beneath top edges of the weight plates in the manner of a standard dumbbell and a second loop type hand grip that in use has a top gripping portion that that is vertically positioned above the left and right ends of the handle and above top edges of the weight plates in the manner of a kettlebell exercise device. A selector is movable into different positions relative to the handle and relative to the weight plates for coupling selected numbers of left weight plates to the left end of the handle and selected numbers of right weight plates to the right end of the handle.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
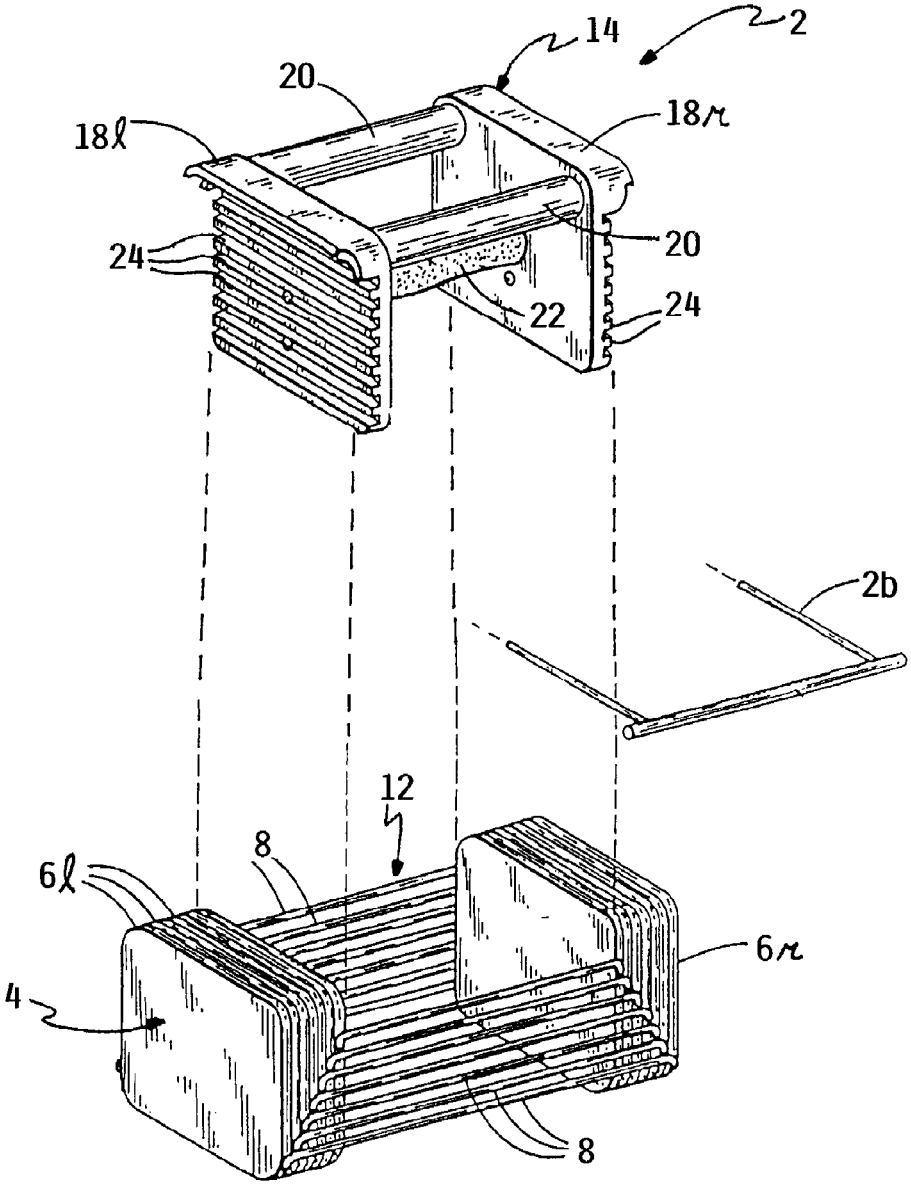
FIG. 1 (PRIOR ART)
FIG. 1 is an exploded, perspective view of a prior art selectorized dumbbell known as the PowerBlock®.

A selectorized dumbbell of the type with which this invention can be used is shown as 2 in FIG. 1. Dumbbell 2 is one of the PowerBlock® lines of dumbbells manufactured and sold by Power Block, Inc. of Owatonna, Minn. The details of such dumbbell 2 are disclosed in U.S. Pat. No. 5,637,034, assigned to the assignee of this invention, which is hereby incorporated by reference.

One characteristic of dumbbell 2 is the use of a plurality of nested weights 4. Each weight 4 comprises a left weight plate **6*l*, a right weight plate 6*r*, and a pair of side rails 8 that hold weight plates 6 in a spaced apart orientation. Side rails 8 are attached in any suitable manner to the front and back edges of the pair of weight plates 6 that form one of weights 4** at the same vertical height along the front and back edges.

Weights 4 are nested in the sense that the left and right weight plates **6*l* and 6*r* in each weight 4 are progressively spaced apart slightly further from one another. Thus, all of the left weight plates 6*l* are nested against one another in a set of nested left weight plates 6*l* and all of the right weight plates 6*r* are nested against one another in a set of nested right weight plates 6*r*. Obviously, to make this happen, side rails 8 used in each weight 4 in a set of weights 4 have progressively longer lengths. Side rails 8 used in the innermost weight will be the shortest with side rails 8 then becoming progressively longer as required to space weight plates 6 in the other weights 4 progressively further apart. This is shown in FIG. 1 by the progressively longer lengths of side rails 8** proceeding from top to bottom.

A gap 12 is provided between the sets of nested left weight plates **6*l* and nested right weight plates 6*r*. A handle 14 can be dropped down into gap 12. Handle 14 has a pair of opposite left and right ends 18*l* and 18*r* that are connected together by spacers or cross tubes 20. The user can drop his hand down between the two upper cross tubes 20 to grip a hand grip 22 that extends between the ends 18*l* and 18*r* of handle 14 parallel to cross tubes 20. Hand grip 22 fixedly connects to the laterally spaced ends 18*l* and 18*r* of handle 14 approximately at the centers of the ends 18*l* and 18*r* of handle 14**.

Each end **18*l* and 18*r* of handle 14 has a vertical array of slots 24 that traverse across the end 18*l* and 18*r* of handle 14 from the front to the back of handle 14. Slots 24 are substantially horizontal grooves or shelves cut or formed into the ends 18*l* and 18*r* of handle 14. Slots 24 are adapted to receive a pair of horizontal prongs on a selector 26 that is used to adjust how many weights are attached to handle 14**.

Once handle 14 has been inserted by the user in gap 12, a desired number of weights 4 can be selectively coupled to handle 14 depending upon how selector 26 is positioned. If selector 26 is inserted into handle 4 beneath the lowermost side rails 8, then selector 26 will pick up all weights 4 when handle 14 is lifted. Moving selector 26 up will pick up fewer weights to thereby adjust the exercise mass carried by handle 14. Essentially, only those weights 4 whose side rails 8 are above the location of selector 26 will be coupled to handle 14.

Figure 2:
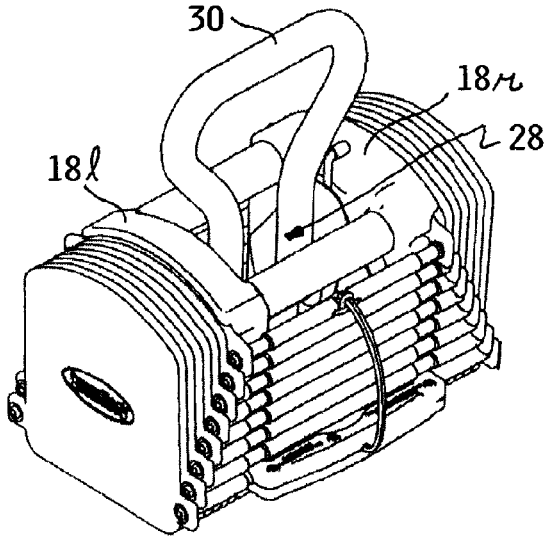
FIG. 2 is a perspective view of a first embodiment of a selectorized dumbbell that is convertible to a kettlebell configuration.

FIG. 2 shows a first embodiment of a dumbbell 2 according to this invention. In this embodiment, a handle 14 like that shown in FIG. 1 is used except that the usual dumbbell style hand grip 22 has been replaced with a kettlebell hand grip 28. Kettlebell hand grip 28 will be fixedly secured in any suitable manner to each end 18*l* and 18*r* of handle 14 in place of dumbbell hand grip 22. Kettlebell hand grip 28 includes an upwardly extending loop 30 that protrudes above weights 4 in the manner of a kettlebell exercise device. Thus, the user can grip loop 30 and lift and swing dumbbell 2 in the manner of a kettlebell.

It would be possible for dumbbell hand grip 22 and for kettlebell hand grip 28 to each be removable and replaceable from within handle 14, e.g. by unbolting or unscrewing one hand grip and by then installing the other hand grip. Thus, one would convert dumbbell 2 from its traditional dumbbell use to kettlebell use by swapping out just the hand grip portions 22 or 28 of handle 14. However, it would also be possible to sell and for a user to purchase two complete handles 14, one with a dumbbell hand grip 22 and the other with a kettlebell hand grip 28, with the user simply using whichever handle 14 that he or she desires at any given time. This latter alternative is attractive because the user does not have to bolt or unscrew anything to make the conversion. All the user has to do is pick up whichever handle 14 that has the hand grip style the user wishes to use and then drop that handle down into gap 12 of dumbbell 2.

Figure 3:
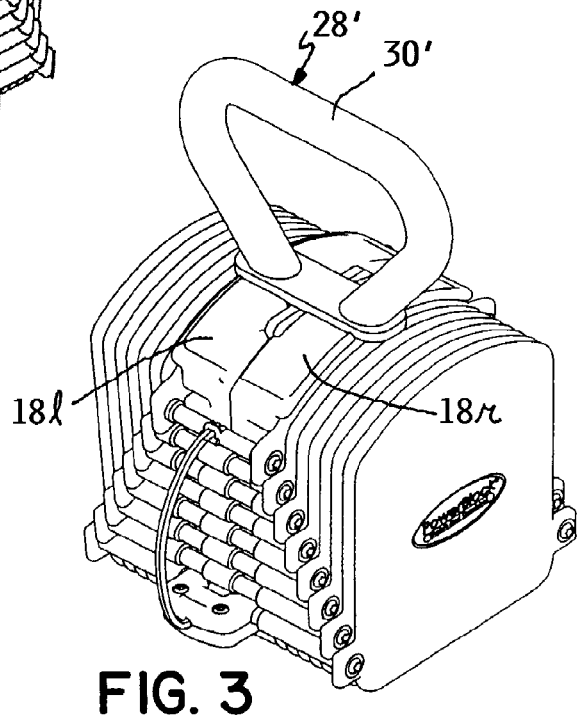
FIG. 3 is a perspective view of a second embodiment of a selectorized dumbbell having a dedicated kettlebell configuration.
Figure 4:
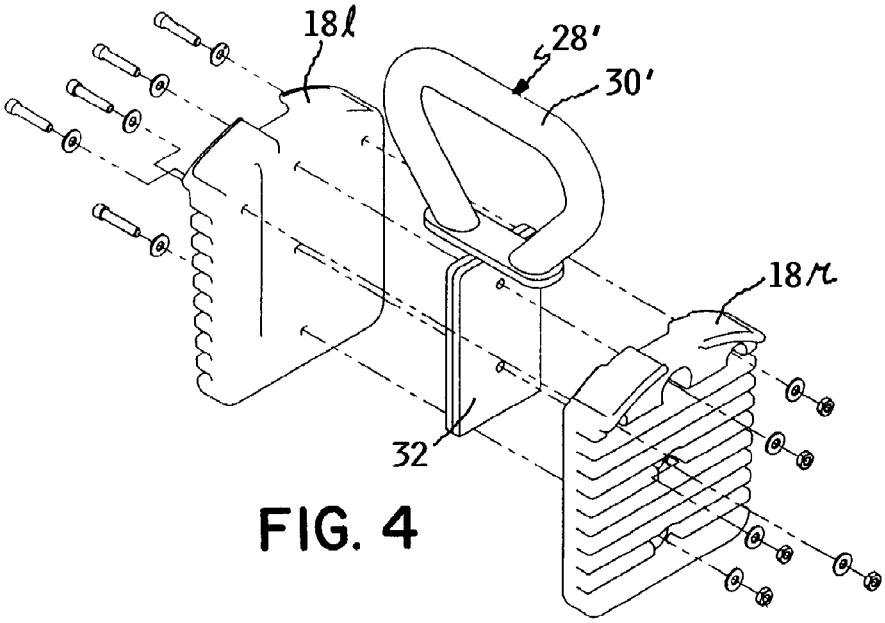
FIG. 4 is an exploded, perspective view of the handle of the selectorized dumbbell of FIG. 3.

FIGS. 3 and 4 show a second embodiment of a dumbbell 2 according to this invention. This embodiment is a dedicated kettlebell style of dumbbell 2 in which the gap 12 in the nested weights 4 is narrowed so that it is no longer wide enough to accommodate a user's hand, i.e. it is no longer possible to use a dumbbell hand grip 22 in gap 12. The only way for a user to use dumbbell 2 as shown in FIG. 4 is in the manner of a kettlebell. Thus, handle 14 includes only a kettlebell hand grip 28' with a loop 30' protruding up above weights 4.

As shown in FIG. 4, handle 14 in this embodiment includes the ends 18*l* and 18*r*, but such ends 18*l* and 18*r* are now spaced apart far enough simply to receive a mounting flange 32 on kettlebell hand grip 28'. In effect, flange 32 is tightly sandwiched and clamped between ends 18*l* and 18*r* when such ends are bolted or screwed together. Loop 30' of kettlebell hand grip 28' is fixed atop flange 32 as shown in FIG. 4. Ends 18*l* and 18*r* of handle 14 can be brought so close together in this embodiment since this version of dumbbell 2 is not designed to function as a normal dumbbell with the user's hand between the spaced weight plates 6, but only as a kettlebell.

Kettlebell hand grips 28, 28' as shown in the embodiments of FIGS. 2 and 3 have the loops 30, 30' thereof extending parallel to the axes of side rails 8. Loops 30, 30' could also be swung around 90° relative thereto to extend perpendicularly to the axes of side rails 8.

Figure 5:
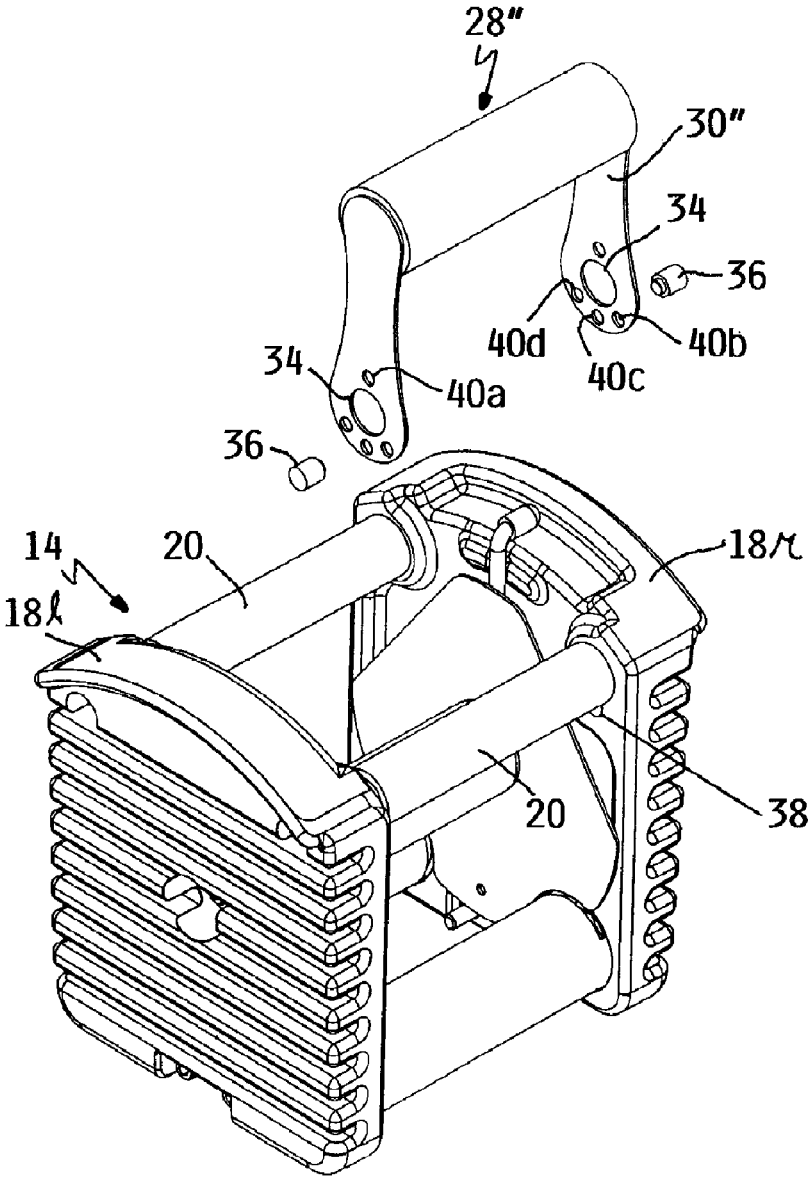
FIG. 5 is a partially exploded, perspective view of a handle of a third embodiment of a selectorized dumbbell that is convertible to a kettlebell configuration.
Figure 6:
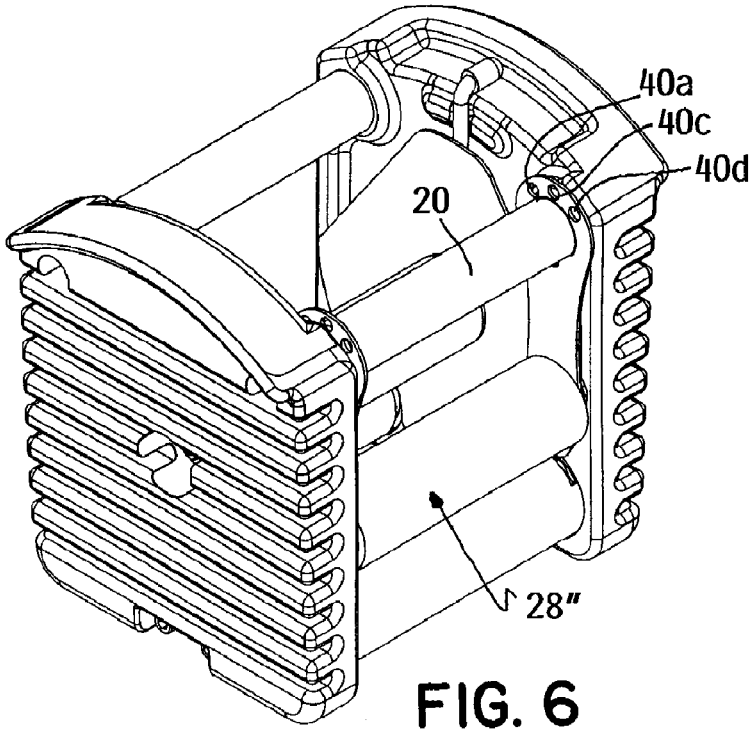
FIG. 6 is an operational, perspective view of the handle of FIG. 5, particularly showing the kettlebell hand grip in a lowered, stowed position in which the kettlebell hand grip is not operational.
Figure 7:
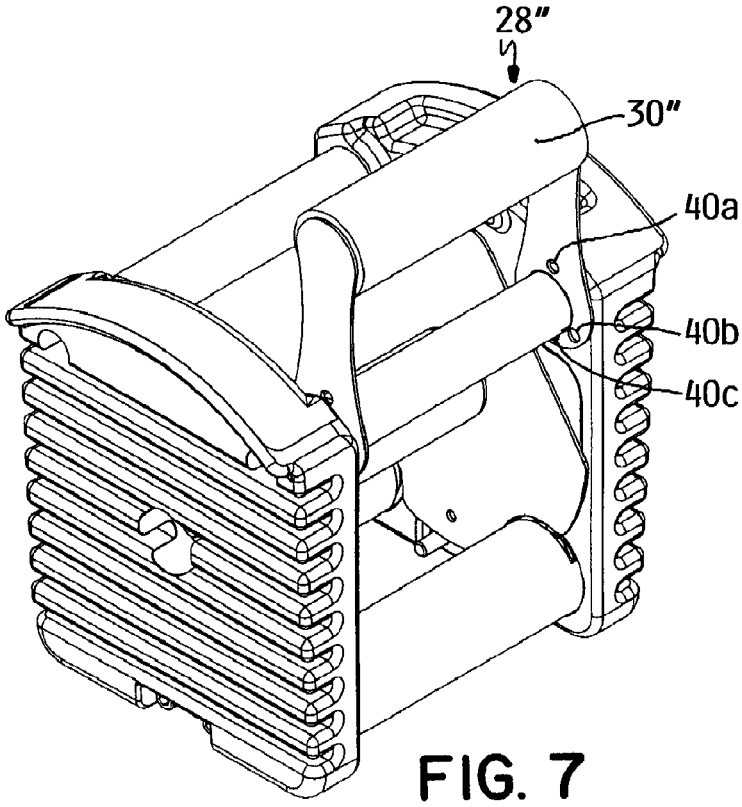
FIG. 7 is an operational, perspective view similar to FIG. 6, but showing the kettlebell hand grip in a raised, accessible position in which the kettlebell hand grip is operational.

Handle 14 for a third embodiment of a dumbbell 2 according to this invention is shown in FIGS. 5-7. This embodiment of dumbbell 2 will use a traditional set of nested weights 4 from the PowerBlock® dumbbell as shown in FIGS. 1 and 2, namely where a normal sized gap 12 is provided such that a full sized handle 14 can be dropped into gap 12. However, for the sake of clarity, the set of nested weights 14 is not shown in FIGS. 5-7. Only the handle 14 is depicted.

Handle 14 of the third embodiment of dumbbell 2 has all the characteristics of the usual handle for a PowerBlock® dumbbell, namely spaced left and right ends 18*l* and 18*r*, upper cross tubes 20 and a dumbbell hand grip 22. However, in this embodiment, handle 14 includes a kettlebell hand grip 28" forming a loop 30" that is installed on handle 14 and is carried with handle 14 in addition to dumbbell hand grip 22. Kettlebell hand grip 28" is selectively movable on handle 14 between a lowered, stowed position and a raised, accessible position. In the lowered, stowed position thereof as shown in FIG. 6, loop 30" is located towards the bottom of handle 14 between the left and right ends 18*l* and 18*r* of handle 14 and cannot be gripped or used by the user since it will normally be obstructed by side rails 8 of weights 4. In the raised, accessible position thereof as shown in FIG. 7, loop 30" is located above all the weights 4 in a position where the user can grip kettlebell hand grip 28 and swing and use weights 4 in the manner of a kettlebell.

Kettlebell hand grip 28" is U-shaped with loop 30" being formed by the U-shape. Kettlebell hand grip 28" has a pair of aligned circular openings 34 in the ends of the legs thereof. This allows kettlebell hand grip 28" to be pivotally mounted on one of the cross tubes 20 of handle 14. The pivoting action of hand grip 28" around cross tube 20, as indicated by arrow A in FIG. 6, is what permits movement of hand grip 28" between the lowered, stowed position thereof and the raised, accessible position thereof. Such pivoting movement will be performed by the user when handle 14 is not inserted within the gap 12 of nested weights 4 in order that such movement not be obstructed by side rails 8.

A detent or lock mechanism is provided in handle 14 to securely hold kettlebell hand grip 28" in its lowered, stowed position or in its raised, accessible position. Such detent or lock mechanism comprises spring biased pop pins 36 that are received in sockets 38 beneath cross tube 20 in each 18*l* and 18*r* of handle 14. See FIG. 5. Only one socket 38 is shown in FIG. 5 in end 18*r* since the corresponding socket in end 18*l* is hidden. Each pop pin 36 cooperates with one of a series of holes 40 located in the legs of hand grip 28" with holes 40 surrounding openings 34 on a diameter that allows each hole 40 to register with pop pin 36. When a hole 40 is brought over and is aligned with pop pin 36 by virtue of pivoting motion of hand grip 28", the internal spring bias on pop pin 36 will cause the head of pop pin 36 to extend and be received in a locking engagement with the hole. The spring force that biases pop pin 36 into such locking engagement is strong enough to hold hand grip 28" in a desired position thereof during use of dumbbell 2, but is not so strong that it cannot be overcome by the user providing manual force on hand grip 28" to pivot hand grip 28" around cross tube 20.

One hole 40*a* is located on one side of opening 34 and is effective to lock hand grip in its lowered, stowed position as shown in FIG. 6. Three holes 40*b*, 40*c*, 40*d* spaced apart in increments of 30° or so are provided on the opposite side of opening 34. One such hole 40*b*, 40*c*, 40*d* is used to receive pop pin 36 and lock hand grip 28" in its raised, accessible position. When middle hole 40*c* is used as shown in FIG. 7, hand grip 28" and loop 30" thereof extend straight up from cross tube 20. If holes 40*b* or 40*d* are used, hand grip 28 and loop 30" will extend upwardly in an inclined fashion tilting either outwardly or inwardly, respectively, with respective to cross tube 20. The series of holes 40*b*-40*d* allows the user to select whatever specific position of hand grip 28" is most comfortable to him or her when using kettlebell hand grip 28 to exercise with dumbbell 2 in the manner of a kettlebell.

The embodiment of dumbbell 2 shown in FIGS. 5-7 is advantageous because it allows a user to quickly and easily convert dumbbell 2 from use as a traditional dumbbell to use as a kettlebell. Only a single handle 14 need be purchased and used by the user. To convert dumbbell 2 into kettlebell use, the user need only lift handle 14 out of gap 12 until it clears the nested weights 4 and then grip kettlebell hand grip 28" and swing it upwardly from the position shown in FIG. 6 to the position shown in FIG. 7. The user can dispose hand grip 28" either straight up and down as shown in FIG. 7 or can incline it inwardly or outwardly depending upon which one of the holes 40*b*-40*d* is used to receive pop pin 36. Then, the user simply drops the converted handle 14 back down into the gap 12 of the nested weights and positions selector 26 to pick up whatever number of weights the user wishes to use. When the user picks up handle 14 again, he or she can pick it up using the now raised and accessible kettlebell hand grip 28" and the selected number of weights will rise with handle 14 for use as the exercise mass in a kettlebell style of exercise.

Various modifications of this invention will be apparent to those of skill in the art. Accordingly, the scope of this invention is to be limited only by the appended claims.

The invention claimed is:

1. A selectorized dumbbell, which comprises:

(a) a plurality of nested weights comprising a stack of nested left weight plates and a stack of nested right weight plates separated by a gap;

(b) at least a first handle having a hand grip extending along an axis with the handle further having opposite, substantially planar left and right ends that are rigidly joined to one another, wherein the handle may be dropped down into the gap between the stacks of nested left and right weight plates such that the left end of the handle is adjacent an innermost left weight plate in the left stack of weight plates and the right end of the handle is adjacent an innermost right weight plate in the right stack of weight plates;

(c) a selector that is movable into different positions relative to the handle and relative to the weight plates for coupling selected numbers of left weight plates to the left end of the handle and selected numbers of right weight plates to the right end of the handle; and (d) wherein the hand grip of the first handle comprises an upwardly extending loop that is fixed at a bottom portion thereof between the left and right ends of the handle to join the left and right ends of the handle together and with the loop having a top gripping portion that is vertically positioned above the left and right ends of the handle and above top edges of the weight plates in the manner of a kettlebell exercise device.

2. The selectorized dumbbell of claim 1, wherein the bottom portion of the loop is releasably fixed to the left and right ends of the handle by fasteners to allow the loop to be removed and replaced with an elongated bar that extends substantially horizontally between top and bottom edges of the left and right ends of the handle such that the bar is located below top edges of the weight plates in the manner of a standard dumbbell.

3. The selectorized dumbbell of claim 1, further including a second handle having a hand grip extending along an axis with the handle further having opposite, substantially planar left and right ends joined to opposite ends of the hand grip with the left and right ends of the handle extending perpendicularly to the hand grip, wherein the hand grip of the second handle extends substantially horizontally between top and bottom edges of the left and right ends of the handle such that the hand grip of the second handle is located below top edges of the weight plates in the manner of a standard dumbbell, and wherein the first and second handles are alternatively usable in the gap between the weight plates depending upon whether the user wishes to use the selectorized dumbbell in the manner of a kettlebell exercise device or in the manner of a standard dumbbell.

4. The selectorized dumbbell of claim 1, wherein the left and right ends of the handle are substantially immediately proximate to one another such that there is insufficient room between the left and right ends of the handle for the reception of a hand of the user therebetween.

5. The selectorized dumbbell of claim 4, wherein a substantially planar mounting flange is attached to the loop and extends downwardly from the loop, and wherein the left and right ends of the handle have portions which are spaced apart from one another only sufficiently to receive the loop mounting flange therebetween such that the loop mounting flange is tightly sandwiched and clamped between the left and right ends of the handle when the ends are fastened together.

6. A selectorized dumbbell, which comprises:

(a) a plurality of nested weights comprising a stack of nested left weight plates and a stack of nested right weight plates separated by a gap;

(b) a handle having a first hand grip extending along an axis with the handle further having opposite, substantially planar left and right ends joined to opposite ends of the hand grip with the left and right ends of the handle extending perpendicularly to the hand grip, wherein the first hand grip of the handle extends substantially horizontally between top and bottom edges of the left and right ends of the handle such that the first hand grip of the handle will be located below top edges of the weight plates in the manner of a standard dumbbell;

(c) a selector that is movable into different positions relative to the handle and relative to the weight plates for coupling selected numbers of left weight plates to the left end of the handle and selected numbers of right weight plates to the right end of the handle; and (d) a second hand grip comprising a loop that is carried on the handle, wherein the loop is movable relative to the handle between a first operative position in which a top gripping portion of the loop is vertically positioned above the left and right ends of the handle and above top edges of the weight plates in the manner of a kettlebell exercise device and a second non-operative position in which the top gripping portion of the loop is disposed between the left and right ends of the handle, wherein the user can use the dumbbell in the manner of a kettlebell exercise device by moving the second hand grip comprising the loop into its first, operative position and by grasping the top gripping portion of the loop or in the manner of a standard dumbbell by disposing the top gripping portion of the loop in its second non-operative position and by grasping the first hand grip rather than the top gripping portion of the loop.

7. The selectorized dumbbell of claim 6, wherein the loop is pivotally carried on the handle to pivot between the first and second positions thereof.

8. The selectorized dumbbell of claim 6, further including a detent or lock mechanism in the handle for holding the loop in either the first or the second position thereof.

9. The selectorized dumbbell of claim 8, wherein the detent or lock mechanism provides a plurality of differently angled orientations of the loop when the loop is in the first operative position thereof such that the user can adjust the angle of the loop relative to the handle to suit the user's preference.

10. A selectorized dumbbell, which comprises:

(a) a plurality of nested weights comprising a stack of nested left weight plates and a stack of nested right weight plates separated by a gap;

(b) a handle having opposite, substantially planar left and right ends that are rigidly joined to one another, wherein the handle may be dropped down into the gap between the stacks of nested left and right weight plates such that the left end of the handle is adjacent an innermost left weight plate in the left stack of weight plates and the right end of the handle is adjacent an innermost right weight plate in the right stack of weight plates, wherein the handle carries a pair or hand grips thereon comprising:

(i) a first cylindrical bar type hand grip that in use is substantially horizontal and extends between the left and right ends of the handle and is disposed beneath top edges of the weight plates in the manner of a standard dumbbell; and (ii) a second loop type hand grip that in use has a top gripping portion that that is vertically positioned above the left and right ends of the handle and above top edges of the weight plates in the manner of a kettlebell exercise device; and (c) a selector that is movable into different positions relative to the handle and relative to the weight plates for coupling selected numbers of left weight plates to the left end of the handle and selected numbers of right weight plates to the right end of the handle.

11. The selectorized dumbbell of claim 10, wherein at least one of the hand grips is movable between an operative position and a non-operative position.

12. The selectorized dumbbell of claim 11, wherein the movable hand grip is the second loop type hand grip.

13. The selectorized dumbbell of claim 12, wherein the handle includes a pair of substantially horizontal cross tubes extending between and joining the left and right ends of the handle at upper portions of the ends along opposite sides thereof, and wherein the second loop type hand grip is pivotally carried for swinging motion around one of the cross tubes of the handle.

14. The selectorized dumbbell of claim 13, wherein the second loop type hand grip pivots around the one cross tube between a vertically raised position forming the operative position and a vertically lowered position forming the non-operative position.

* * * * *